United States Patent [19]

Pujol

[11] 4,067,505

[45] Jan. 10, 1978

[54] HORIZONTAL-AXLE GRINDER WITH ROTATABLE SIEVE

[76] Inventor: Carlos Oliver Pujol, Marina Street No. 51, Badalona (Barcelona), Spain

[21] Appl. No.: 765,983

[22] Filed: Feb. 7, 1977

[30] Foreign Application Priority Data

Nov. 6, 1976 Spain ..... 453093

[51] Int. Cl.[2] ..... B02C 17/18

[52] U.S. Cl. ..... 241/171; 241/73

[58] Field of Search ..... 241/46.04, 46.11, 46.17, 241/73, 171, 172

[56] References Cited

U.S. PATENT DOCUMENTS

| | | | |
|---|---|---|---|
| 3,311,310 | 3/1967 | Engels et al. | 241/171 |
| 3,814,334 | 6/1974 | Funk | 241/73 |

*Primary Examiner*—Granville Y. Custer, Jr.
*Attorney, Agent, or Firm*—Blanchard, Flynn, Thiel, Boutell & Tanis

[57] ABSTRACT

A cooled horizontal-axle grinder for the predispersion of solids in liquids, which grinder incorporates a grinding chamber having grinding bodies such as balls therein. The grinder has a circulating pump for the product to be treated which circulates in a continuous manner through the grinding chamber. The rotatable grinder axle carries discs or agitator elements. The grinder includes a separating sieve designed to retain the grinding balls within the grinding chamber while permitting the finely ground product to flow into the interior thereof and then along and around the axle. The sieve includes a cylinder coaxial and rotatable with the axle and having slots of suitable shape to realize the aforementioned function. The cylinder has product outlet holes which communicate with a surrounding cylindrical product chamber. A separator structure surrounds this rotatable cylinder and coacts with a housing wall for defining a narrow flow passage which communicates directly between the grinding and product chambers. The passage is sized similar to the slots in the sieve.

1 Claim, 3 Drawing Figures

HORIZONTAL-AXLE GRINDER WITH ROTATABLE SIEVE

FIELD OF THE INVENTION

The present invention refers to improvements in cooled horizontal-axle grinders for the predispersion of solids in liquids and, in particular, to improvements in the grinder disclosed in my copending application Ser. No. 729 299, filed Oct. 4, 1976.

BACKGROUND OF THE INVENTION

In the invention of my above-mentioned application, improvements have been conceived relating to cooled horizontal-axle grinders for the predispersion of solids in liquids of high or medium viscosity, which grinders are of the type which incorporate grinding bodies, for example balls, which are generally introduced through the treated product inlet port and extracted through an outlet situated in the lower part of the chamber, where this grinding chamber is provided with a double wall for the corresponding cooling mechanism and, in turn, with a circulating pump for the liquid coolant in question, and also incorporates an axle or shaft on which are mounted corresponding interchangeable agitator discs situated at predetermined distances from each other by means of separators, where this shaft is driven by a motor through a suitable transmission system and speed regulator; the system also contains a pump and corresponding flow regulator which impel the product being treated.

The improvements which are the object of the invention in the above-mentioned application relate to an element acting as a filter, which retains the grinding bodies in the interior of the grinding chamber, while giving passage exclusively to the product as it is treated. This filter comprises a sieve mounted coaxially with and around the axle and joined to it in such a way that the sieve rotates with the axle, thereby retaining the grinding balls in the grinding chamber while permitting the finely ground product to flow through the sieve into an extraction chamber for discharge to the exterior.

The improvements which are the object of this invention refer to a new separating system between the grinding chamber and the extraction chamber for the ground product, which separating system is to be substituted for the conventional seal assembly used in the grinder of my earlier application. This new separating system consists essentially of a static perforated metal disc and a coaxial metal ring which rotates with respect to it, and which is joined to the sieve or filter element which rotates with the grinder axle. The separation or spacing between both elements, the static perforated disc and the coaxial ring, is constant and is equal to or less than the separation or the pass diameter of the sieve, and may lie between 0.2 and 1 mm.

The following advantages, with respect to the conventional seal assembly represented in my earlier application, are obtained with this new system:

1. Wear due to abrasion is eliminated.
2. The ground product output area is increased.
3. The pressure in the grinding chamber is reduced.
4. The surface is smoother, which makes cleaning easier.

DETAILED DESCRIPTION

Figure 1:
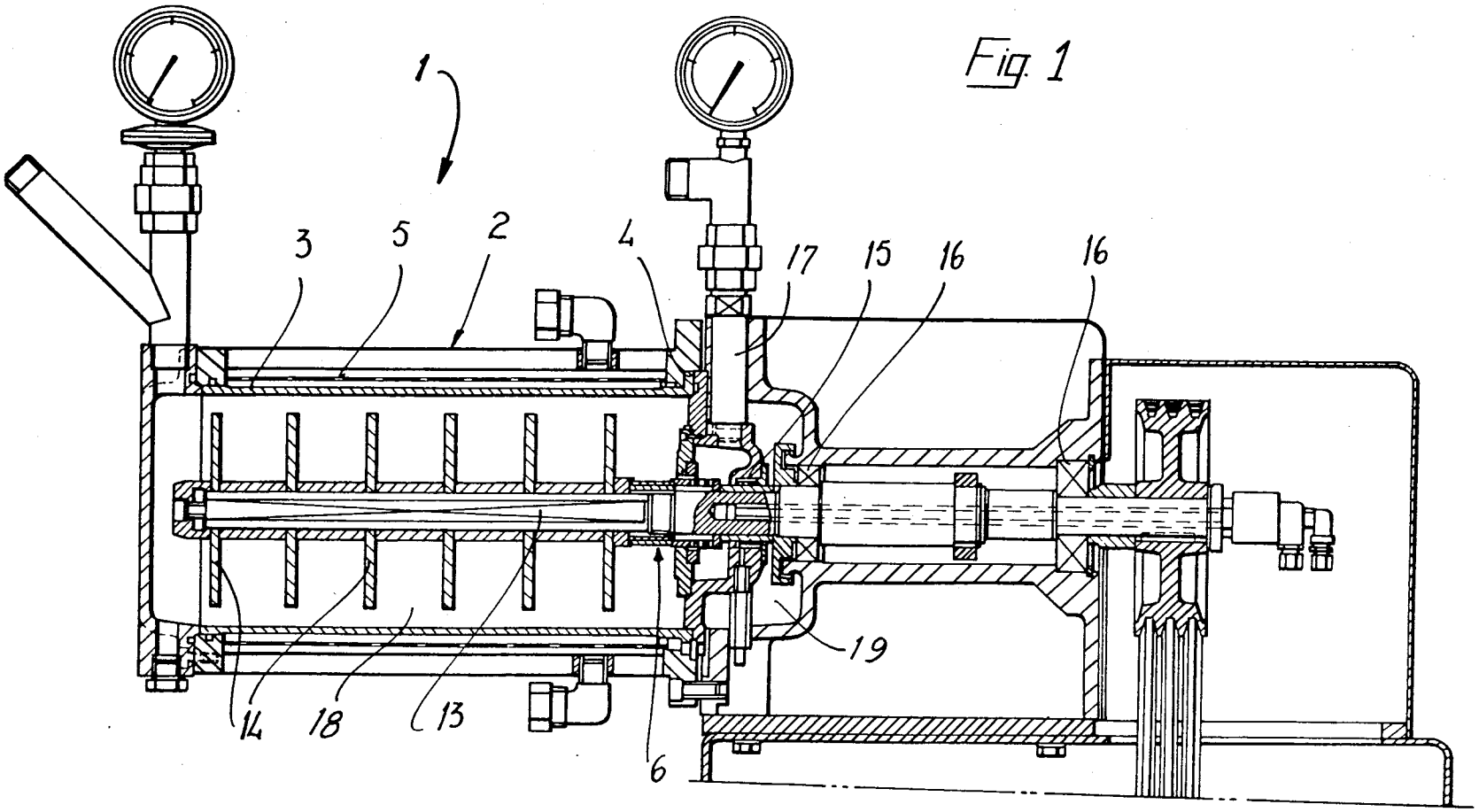
FIG. 1 corresponds to a longitudinal sectional view of the grinding chamber in which is situated a filter.
Figure 2:
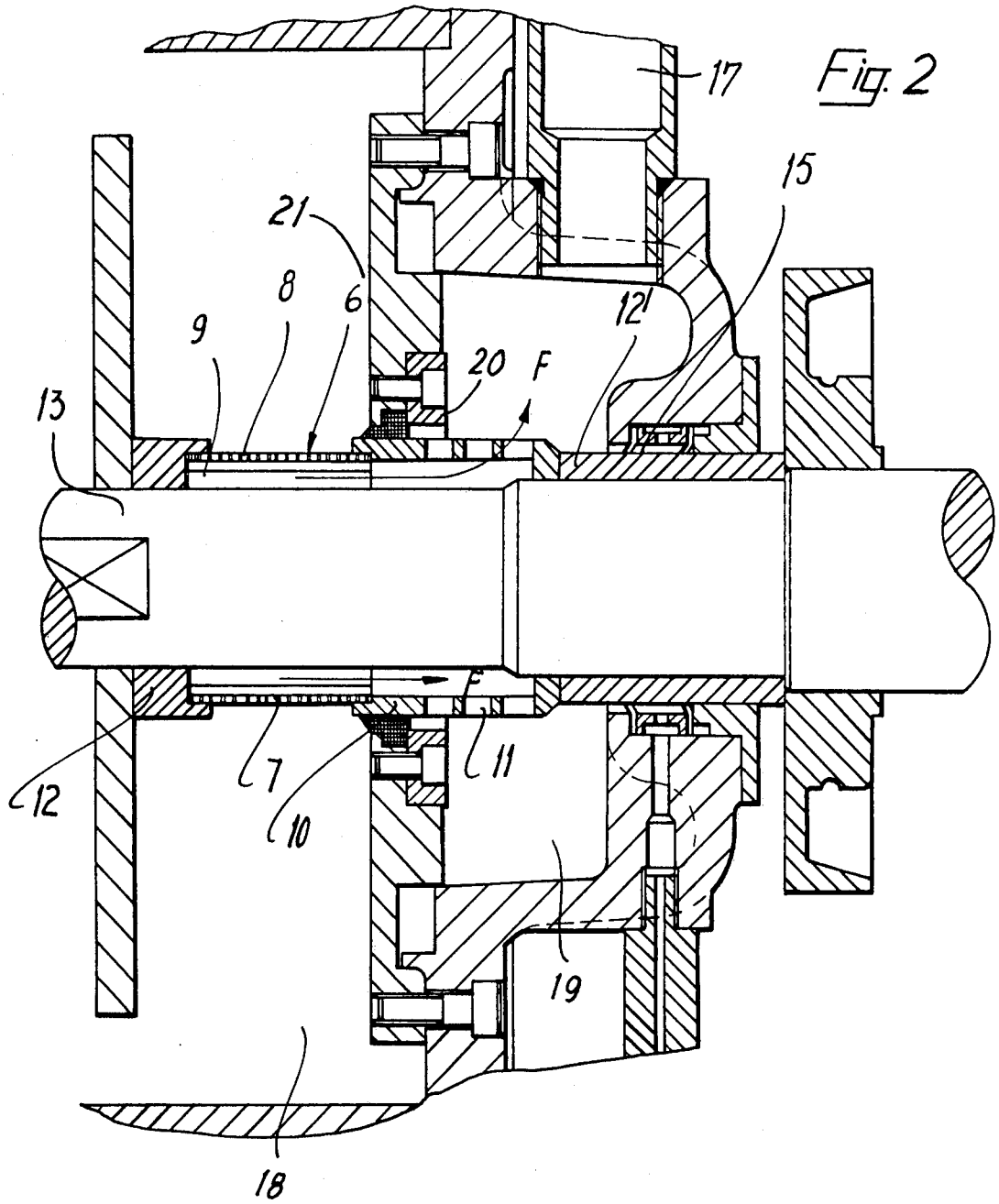
FIG. 2 shows details, in section, of the filter and its mounting.

With reference to FIGS. 1 and 2, the implementation comprises a machine 1 having a body 2 which incorporates the body proper of the horizontal axle grinder. This grinder has a jacket 3 which defines therein the grinding chamber. The jacket is mounted in an unconstrained arrangement, being fixed at one extreme 4 and free at the other, which arrangement permits the absorption of differential expansion as produced between the internal grinding chamber 18 and the external cooling chamber 5, thereby avoiding cracks or ruptures in its body welding caused by the stresses set up by differential expansion between the component parts.

In the aforementioned grinding chamber there is provided a separating sieve 6 formed by a coaxial cylinder 7 which circular slots or openings 8 of suitable dimension for retaining the grinding bodies within the grinding chamber while permitting the finely ground product to freely flow through the sieve and in the direction of the arrows F; which product then circulates through the annular space 9 formed between the axle 13 and the cylinder 7, and then through the holes 11 in the chamber outlet cylinder 10 for discharge into an extraction chamber 19, from which it flows out through the outlet pipe 17.

The sieve assembly 6 is thus formed by the cylinder 7 and the cylinder 10, both elements being coupled coaxially, since there exists a support piece 12 for the cylinder 7 and another support piece 12′ for the cylinder 10.

The sieve assembly 6 thus rotates jointly with the axle 13 on which there is mounted the agitator discs 14. A conventional seal assembly 20 coacts between the rotating cylinder 10 and the jacket wall 21 for sealingly separating the chambers 18 and 19.

Due to the rotation of the cylinder 7, the balls contained in the grinding chamber are displaced towards the exterior of the grinding chamber as a result of the centrifugal force caused by the rotation of cylinder 7, whereby scarcely any abrasion is produced on the exterior of cylinder 7.

With this type of sieve there is no requirement for any type of regulation mechanism, it being self-cleaning due to its rotation.

The axle or shaft 13 incorporates a cooling system to dissipate the heat produced in parts subject to friction, such as the seal 15, axial bearings 16 etc., which cooling system is formed by a rotatable dual-passage joint connected to the axle and whose function consists in introducing and draining the liquid coolant through a tube with a teflon guide at one end. This cooling system is described in my copending application Ser. No. 729 298.

The cooling of the end seal 15 assembly is effected by means of a circuit formed by an impulse-activated membrane pump where there is a reservoir mounted on the grinder axle and liquid delivery and return tubes to the seal and reservoir respectively. On connecting up the machine, the seal cooling is automatically brought into action, in such a form as never to rotate while dry, so as to prevent damage to the seal lip caused by lack of lubrication and an excessive operating temperature.

The structure as described above, and as shown in FIGS. 1 and 2, corresponds to the grinder disclosed in my above-mentioned application Ser. No. 297,299.

Figure 3:
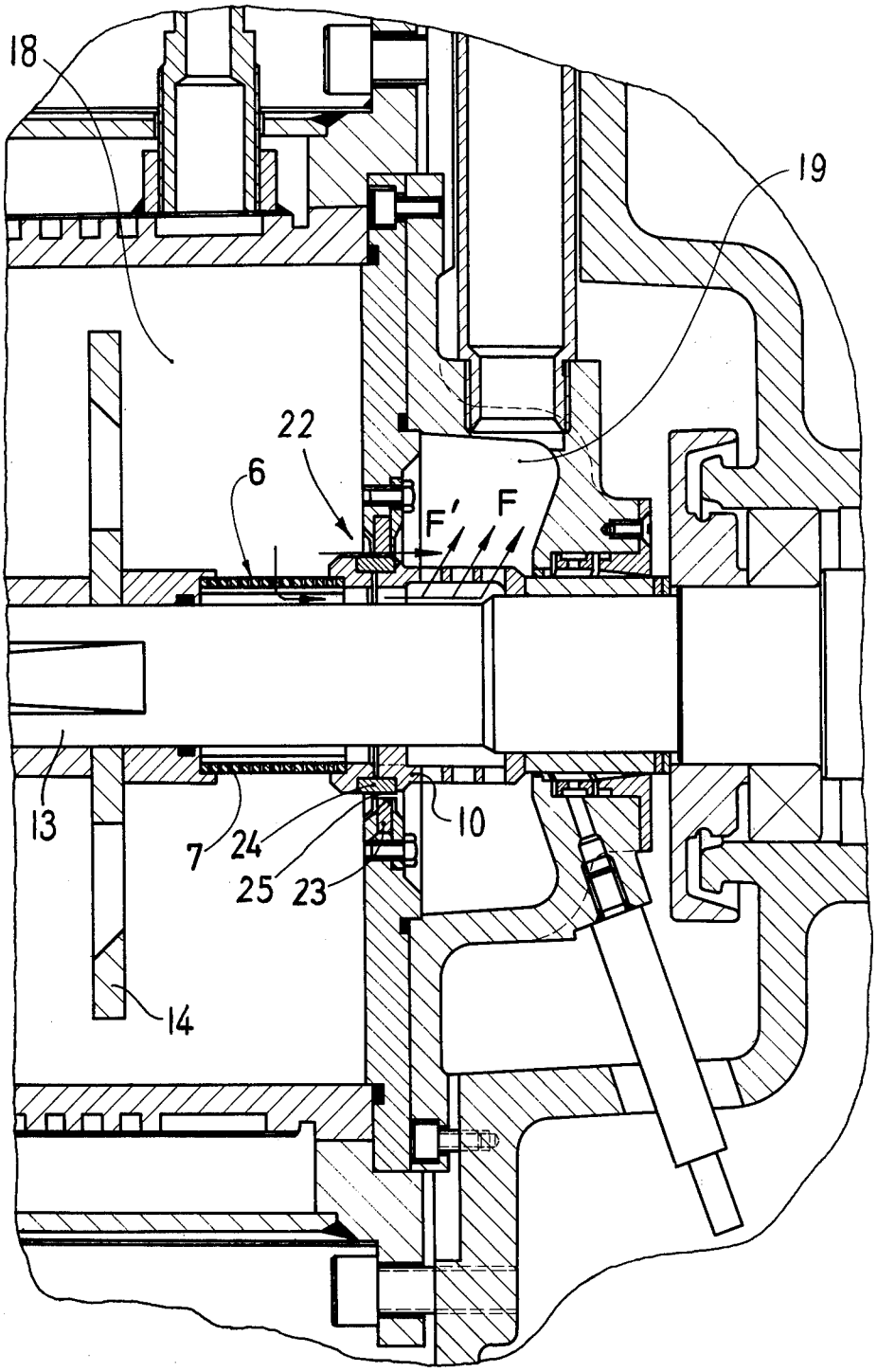
FIG. 3 shows a detailed section of the area of the grinder in which the improvements, which are the object of this invention, are located.

Considering now the present invention, and as shown in FIG. 3, this invention consists of a new separation system 22 between the grinding chamber 18 and the ground product extraction chamber 19, which new system replaces the conventional seal assembly 20 shown in FIG. 1.

This new system 22 consists of a static metal disc 23 mounted on the jacket wall and a coaxial ring 24 fixedly joined to the cylindrical sleeve 10 which forms an integral part of the sieve assembly 6, whose other component is the sieve 7.

There is a constant separation or spacing 25 between the disc 23 and the ring 24, which is equal to or less than the opening size or the pass diameter of the sieve 7.

As is clear from FIG. 3, this new center separator 22 offers the possibility of eliminating the wear produced by abrasion which is common in a conventional seal assembly; furthermore, it increases the ground product output area as shown by the arrows F and F′, with a consequent reduction in the pressure in the grinding chamber 18 and, finally, it facilitates cleaning, since it avoids the use of surfaces which are more or less undulating or angled, such as those in known retainers.

The invention, in essence, can be implemented in other forms of realization which may differ in detail from that outlined by way of an example in the description, but which will equally receive the patent protection obtained. Thus, it may be constructed in whatever shape or form, and with whatever materials and means most suitable, while all of this remains encompassed within the spirit of the claims.

The embodiments of the invention in which an exclusive property or privilege is claimed are defined as follows:

1. In a cooled horizontal-axle grinder, such as for the predispersion of solids in liquids, which grinder includes wall means defining therein a grinding chamber and a product extraction chamber;

grinding bodies such as balls positioned within said grinding chamber;

a rotatable agitator shaft extending through said grinding chamber and supported for rotation about a substantially horizontal axis, a plurality of agitator discs mounted on said shaft for rotation therewith, said discs being axially spaced apart along said shaft and having an endmost disc positioned adjacent but axially spaced from a part of said wall means to define a substantially annular region therebetween which surrounds said shaft and comprises a part of said grinding chamber;

and a sieve structure associated with said region for straining the treated product which is withdrawn from the grinding chamber and supplied to said extraction chamber, said sieve structure including a first mounting structure fixed to said shaft and disposed adjacent the endmost disc, a second mounting structure fixed to said shaft in axially spaced relationship to said first mounting structure and positioned in the vicinity of said part, an elongated sleeve-like sieve fixedly mounted on and extending axially between said first and second mounting structures in concentric relation with said shaft, said extraction chamber communicating with said region of the grinding chamber through said sieve, said region also being free of obstructions except for the presence of said sieve, whereby the treated product can flow from said grinding chamber radially inwardly through said region and then radially inwardly through said sieve into said extraction chamber, from which the treated product is discharged;

the improvement comprising separation means disposed between the grinding chamber and the product extraction chamber for permitting the flow of additional treated product into said extraction chamber, said separation means including an annular disc fixed with respect to said part and positioned in surrounding and concentric relationship to a ring which is coaxial with said shaft and is fixed to said second mounting structure for rotation therewith, said disc and ring having opposed annular peripheral surfaces which are positioned a fixed distance apart so as to define a narrow annular flow passage therebetween which provides communication between said grinding and extraction chambers, said distance being less than or equal to the pass diameter of the sieve.

* * * * *